United States Patent [19]

Zocher

[11] 4,131,978

[45] Jan. 2, 1979

[54] FELTING NEEDLE

[75] Inventor: Josef Zocher, Haaren, Fed. Rep. of Germany

[73] Assignee: The Singer Company, New York, N.Y.

[21] Appl. No.: 849,827

[22] Filed: Nov. 9, 1977

[51] Int. Cl.[2] ..... D04H 18/00

[52] U.S. Cl. ..... 28/115

[58] Field of Search ..... 28/115

[56] References Cited

U.S. PATENT DOCUMENTS

| | | | |
|---|---|---|---|
| 2,322,573 | 6/1943 | Foster | 28/115 |
| 2,857,650 | 10/1958 | Lauterbach | 28/115 |
| 2,958,113 | 11/1960 | Lauterbach | 28/115 X |
| 3,641,636 | 2/1972 | Foster | 28/115 |
| 3,983,611 | 10/1976 | Zocher | 28/115 |
| 4,030,170 | 6/1977 | Eckhardt | 28/115 |

FOREIGN PATENT DOCUMENTS 2518066 11/1976 Fed. Rep. of Germany.

*Primary Examiner*—Robert Mackey

*Attorney, Agent, or Firm*—Edward L. Bell; Robert E. Smith; Alan Ruderman

[57] ABSTRACT

A felting needle with a barb having a fiber deflecting section and a fiber gripping section. The barb is within a triangular blade needle and has a fiber gripping section disposed in the bottom portion of the trailing edge of the barb and disposed at approximately a 70 degree undercut angle relative to the needle axis and the fiber deflecting section extends upwardly and rearwardly from the fiber gripping section at approximately 30 degrees to the needle axis. The effective depth of the gripping section is less than approximately 75% of the total barb depth. With this arrangement, owing to the barb fiber gripping edge positioned within the triangular blade and with no kick-up, the backing material fibers are protected and fiber distortion is reduced.

8 Claims, 4 Drawing Figures

FELTING NEEDLE

BACKGROUND OF THE INVENTION

This invention relates to needles and more particularly to felting needles having an improved fiber protecting barb construction.

Felting needles are in use in the needle punching process for compacting a fiber web into a backing material. These needles have fiber engaging barbs on the needle edges that act to compact the fibers by forceably orienting them into a dense web. The quality of a highly compacted needle product is highly dependent upon the amount of fiber and backing distortion produced during the process. It is therefore important that the fibers and the backing be protected so that distortion is minimized. This is especially critical for brittle fibers and those that have low tensile strength. The barb of the needle is the proportion that grips the fibers to interlace and orient them into a compact web. However, with the barb constructions of the prior art, as the degree of fiber gripping increased, so did the degree of distortion. Some examples of prior art felting needle barb constructions are illustrated in U.S. Pat. Nos. 2,857,650; 3,641,638; 3,983,611; and 4,030,170. The needle disclosed in the latter patent is free of the so called bard "kick-up" i.e., the trailing tip of the barb does not protrude above the edge of the blade.

SUMMARY OF THE INVENTION

The present invention overcomes the problems of the prior art needles by providing a felting needle having a barb with a fiber deflecting section and a fiber gripping section. The fiber gripping section is disposed in the bottom portion of the trailing edge of the barb and disposed at an undercut angle relative to the needle axis and the fiber deflecting section extends upwardly and rearwardly from the fiber gripping section. The effective depth of the gripping section is less than approximately 75% of the total barb depth. With this arrangement, owing to the barb fiber gripping edge positioned within the triangular blade and with no kick-up, the backing material fibers are protected and fiber distortion is reduced.

In a preferred embodiment, the fiber gripping section is disposed at approximately 70 degrees to the needle axis and the fiber deflecting section is disposed at approximately 30 degrees to the needle axis. The leading edge of the barb enters into the bottom of the barb at approximately 35 degrees to the needle axis, while the bottom of the barb is disposed 10 degrees to the needle axis and is undercut toward the point of the needle.

Consequently, it is a primary object of the present invention to provide a felting needle having a novel barb construction that provides protection of the backing material fibers and a reduction of the distortion of the web fibers.

It is another object of this invention to provide a felting needle having a barb construction with a fiber gripping section and a fiber deflecting section.

BRIEF DESCRIPTION OF THE DRAWINGS

The particular features and advantages of the invention as well as other objects will become apparent from the following decription taken in connection with the accompanying drawings, in which.

DESCRIPTION OF THE PREFERRED EMBODIMENT

Figure 1:
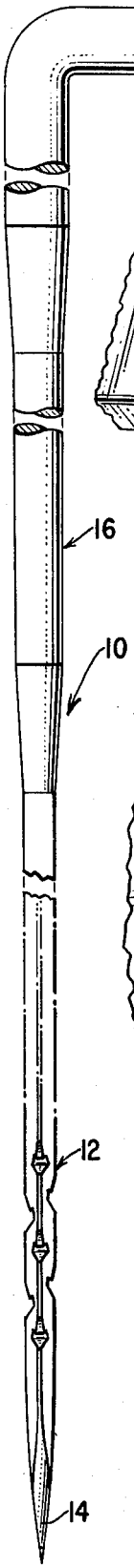
FIG. 1 is an elevational view of a felting needle constructed in accordance with the principles of the present invention.

Referring now to FIG. 1, a felting needle 10 constructed in accordance with the principles of the present invention is illustrated as comprising a blade portion 12 having a point portion 14 at its lower end and a shank portion 16 at its upper end. The upper most end of the needle may be bent substantially at right angles to the shank portion to provide a securing element or ear 18 for clamping in a conventional needle board (not illustrated). As is well known, such a needle board is adapted to support a multiplicity of felting needles, such as that shown in FIG. 1, for reciprocation to effect an interlacing and compacting of loose fibrous materials into a web.

In the preferred form of the invention the felting needle is provided with a blade portion having three inclined side surfaces 20 merging into flat edge surfaces 22 so that the cross-sectional configuration is substantially triangular with truncated apexes. However, other crosssectional configurations having inclined sides could readily incorporate the barb construction of this invention.

Figure 2:
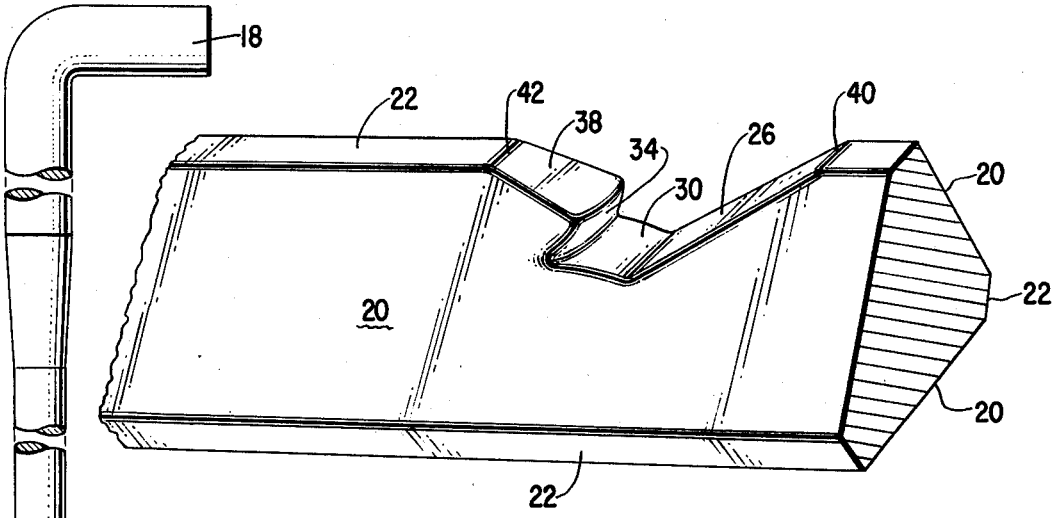
FIG. 2 is a perspective view of a fragment of the needle of FIG. 1 illustrating the construction of one barb.
Figure 3:
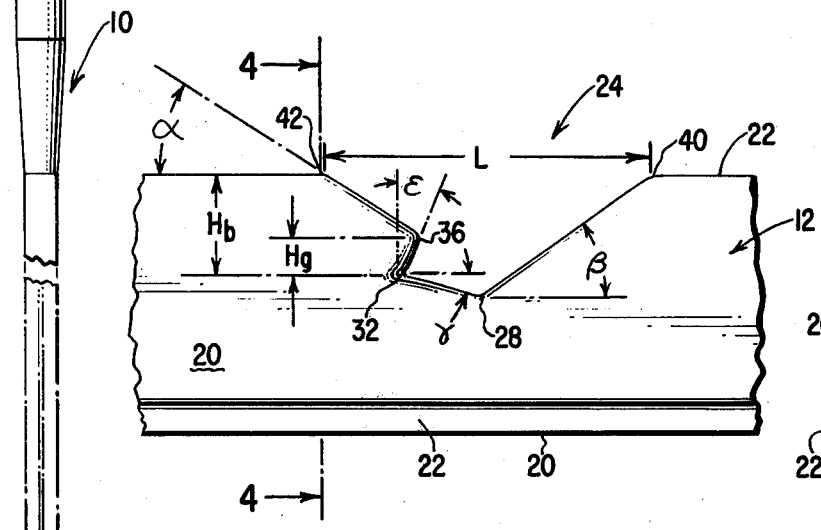
FIG. 3 is an elevational view of a fragment of the needle of FIG. 1 illustrating one barb.

A barb, indicated at 24, is die pressed into the flat edge surface 22. Preferably, a multiplicity of such barbs are pressed into each surface 22. As illustrated in FIG. 2, each barb includes a ramp 26 inclined at an angle $\beta$ inwardly toward the center of the needle from the surface 22 and rearwardly from the point portion toward the shank. The ramp terminates at its lower end at an edge 28 from which a bottom surface 30 extends rearwardly and outwardly toward the edge 22 at an angle $\gamma$ to the needle axis to an edge 32. A fiber gripping surface 34 extends outwardly and forwardly to an edge 36 so as to be inclined at an undercut angle $\epsilon$. From the point 36 the barb includes a fiber deflecting surface 38 inclined at an angle $\alpha$ to the needle axis and extending rearwardly and outwardly into the flat edge 22.

Figure 4:
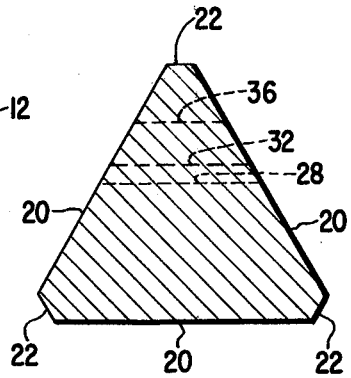
FIG. 4 is a cross-sectional view taken substantially along the line 4—4 of FIG. 3.

As illustrated in FIG. 2, the surfaces 26, 30, 34 and 38 are smoothly contoured with the surface 34 having a relatively large radius. As can be seen from FIG. 4, the fiber gripping surface 34, since it is substantially beneath the flat edge 22, is of a larger radius transversly than the barbs of the prior art which are at the edge. This eliminates sharp bending of the fibers during the punching process and thus eliminates breakage of low strength fiber strands.

The gripping edge 36 is of a length $H_g$ from the edge 32 in a plane normal to the needle axis, and the edge 32 is spaced below the flat edge 22 a distance $H_b$. Thus, the barb depth is $H_b$ and the effective depth of the gripping portion of the barb is $H_g$. It has been found that good results are obtained when the ratio of $H_g/H_b$ is less than approximately 0.75, i.e., the effective depth of the gripping section of the barb is less than approximately 75% of the total barb depth. The length L of the barb, i.e., from edge 40 to edge 42 is approximately four times larger than the depth $H_g$ of the barb so as to allow the fibers into the gripping portion and to limit the backing from entering.

In the preferred construction of the needle, the angle $\alpha$ is 30 degrees, the angle $\beta$ is 35 degrees, the angle $\gamma$ is 10 degrees and the angle $\epsilon$ is 20 degrees. In the latter instance, since $\epsilon$ is 20 degrees, the fiber gripping surface 34 is inclined approximately 70 degrees to the needle axis. In each instance these values of the angles are approximate and should not be considered as absolute.

Since the fiber gripping surface 34 is smaller, but protected, relative to the prior art needles, it is preferred that there is a large number of barbs along each edge 22. It has been found that ideally the spacing between barbs along one edge 22 should be three to six times the individual barb length L. However, it should be understood that since the effective depth $H_g$ of the barb is within the triangular blade, i.e., below the edge 22, the surface 34 is transversly wider than that of prior art needles which have the barbs positioned closer to the edge. This provides a relatively large surface for guiding fibers even though the effective barb depth is small. Relative to prior art needles having deep barb depths, the described needle construction grips smaller quantities of fiber, but protects the fibers and because the surface 34 is protected within the barb, the backing material and the barb tip are protected.

Numerous alterations of the structure herein disclosed will suggest themselves to those skilled in the art. However, it is to be understood that the present diclosure relates to a preferred embodiment of the invention which is for purposes of illustration only and not to be construed as a limitation of the invention. All such modifications which do not depart from the spirit of the invention are intended to be included within the scope of the appended claims.

Having thus described the nature of the invention, what I claim herein is:

1. An axially extending felting needle including a point portion at the front end, a shank portion at the rear end, and a blade portion, intermediate said point and shank portions, said blade portion having at least two inclined side surfaces merging into a flat edge surface, a fiber transporting barb provided on said flat edge surface, said barb comprising a ramp inclined inwardly and rearwardly from the flat edge toward the center of the needle, a bottom surface merging at its front end with the ramp and inclined outwardly at its rear end, a fiber gripping surface merging with the rear end of the bottom surface and inclined outwardly toward the front of the needle, a barb point formed on said fiber gripping surface, said barb point being located at a depth inwardly of said flat edge surface greater than % of the total barb depth, said fiber gripping surface having a relatively large radius and fully extending between two inclined side surfaces, and a fiber deflecting surface inclined outwardly and rearwardly from the fiber gripping surface and merging into the flat edge surface.

2. A felting needle as recited in claim 1 wherein the length of the barb from the top of the ramp to the top of the fiber deflecting surface is approximately 4 times the depth of the barb from the flat edge to the rear end of the bottom surface projected onto said plane.

3. A felting needle as recited in claim 2 including a plurality of barbs on said flat edge, the spacing between barbs being approximately 3 to 6 times the length of each barb.

4. A felting needle as recited in claim 1 wherein the fiber deflecting surface is inclined approximately 30 degrees to the needle axis.

5. A felting needle as recited in claim 4 wherein the fiber gripping surface is inclined approximately 70 degrees to the needle axis.

6. A felting needle as recited in claim 5 wherein the ramp is inclined approximately 35 degrees to the needle axis.

7. A felting needle as recited in claim 6 wherein the bottom surface is inclined approximately 10 degrees to the needle axis.

8. A felting needle as recited in claim 1 wherein the cross-sectional configuration of said needle is triangular with truncated apexes defining flat edge surfaces, each of said flat edge surface having a plurality of barbs.

* * * * *